United States Patent [19]

Hall

[11] Patent Number: 4,464,854

[45] Date of Patent: Aug. 14, 1984

[54] CORRECTIONAL COLLAR

[76] Inventor: Marvin R. Hall, Star Rte., Box 37, Kansas, Okla. 74347

[21] Appl. No.: 483,583

[22] Filed: Apr. 11, 1983

[51] Int. Cl.[3] ..... G09F 3/14

[52] U.S. Cl. ..... 40/21 C; 40/304; 119/106

[58] Field of Search ..... 40/21 C, 21 R, 304; 119/106; 70/16; 24/321, 16 PB; 63/3; 292/314, 315, 316; 248/74 PB

[56] References Cited

U.S. PATENT DOCUMENTS

| | | | |
|---|---|---|---|
| 1,914,726 | 6/1933 | Mercer | 403/393 |
| 3,036,554 | 5/1962 | Johnson | 119/106 |
| 3,565,375 | 2/1971 | Babb | 248/74 PB |
| 3,800,450 | 4/1974 | Laugherty et al. | 40/21 C |
| 4,154,011 | 5/1979 | Rakestraw et al. | 40/21 C |
| 4,174,553 | 11/1979 | Schrougham et al. | 24/321 |
| 4,221,063 | 9/1980 | Charles et al. | 40/21 C |

*Primary Examiner*—John J. Wilson

*Attorney, Agent, or Firm*—William S. Dorman

[57] ABSTRACT

A correctional collar to be worn around the neck of a person convicted of a crime comprising an elongated flexible strip having a width of about one to two inches and a length of about fifteen to thirty inches; the strip having a first pair of transversely spaced holes adjacent one longitudinal end of the strip, the strip being provided with a second pair of transversely spaced holes arranged in parallel relation and longitudinally spaced a first predetermined distance away from the first pair of holes, the opposite end of the strip being provided with a plurality of additional pairs of transversely spaced holes arranged in parallel relation to each other and parallel to the first and second pairs of holes; each pair of holes of the additional pairs of holes being longitudinally spaced from each adjacent pair a second predetermined distance, the holes of all pairs of holes having the same transverse spacing; a plate having a width greater than the transverse spacing between the holes of each pair of holes and a length greater than the first predetermined distance and having holes therein corresponding in size and position to the first and second pairs of holes in the strip; first and second rivet members for securing the plate to the strip; each rivet member having a base and a pair of rivets projecting outwardly from the base in parallel relation to each other and spaced apart about a distance equal to the transverse spacing between the holes of each pair of holes, the outer diameter of each rivet in unflared condition being such that the rivet can pass through the holes in the strip and the holes in the plate.

1 Claim, 4 Drawing Figures

CORRECTIONAL COLLAR

BACKGROUND OF THE INVENTION

1. Field of the Invention

The present invention relates to a correctional collar. More particularly, the correctional collar is worn by a "convict" and is used to identify him as such during all or part of his sentence which is served away from the confines of a penal institution.

2. Prior Art

The use of collars, bracelets, belts and other articles which can be used to encircle a portion of the body have been used in the past to identify the wearer of the article. For example, hospitals use bracelets which go around the wrist of the patient and which are used to identify the patient, the nature of his ailment (sometimes) and possible medications to which he might be allergic. For the most part, these hospital bracelets can be removed only by cutting through the bracelet itself.

As a result of a patentability search which was conducted on the present invention, the following U.S. patents were uncovered: Scott U.S. Pat. No. 115,647, Roberts U.S. Pat. No. 339,214, Ferrell U.S. Pat. No. 583,796, Wilson U.S. Pat. No. 2,324,183, Baumgartner U.S. Pat. No. 3,106,028, Laugherty et al U.S. Pat. No. 3,800,450 and Vail, Jr. U.S. Pat. No. 3,867,905.

The only patents of the above list which relate to "correctional" uses are Farrell U.S. Pat. No. 583,796 and Wilson U.S. Pat. No. 2,234,183. However, these patents involve prisoners or convicts who are already in custody, and these references do not show or suggest the features of the present invention.

Scott U.S. Pat. No. 115,647 and Roberts U.S. Pat. No. 339,214 are pertinent in that they both show lockable collars which are adapted to go on animals, a dog in the first instance, and cattle in the second instance.

The closest patents appear to be Baumgartner U.S. Pat. No. 3,106,028 and Laugherty U.S. Pat. No. 3,800,450; both of these patents relate to identification bands (to go around the arm or wrist) which are locked in place and which must be cut to be removed.

The remaining patent, Vail, Jr. U.S. Pat. No. 3,867,905 is not considered to be sufficiently pertinent as to require any comment.

The patents uncovered in the preliminary search, for the above reasons, do not show or suggest the features of the present invention, as will hereinafter more clearly appear.

SUMMARY OF THE INVENTION

The present invention relates to an identification collar which can be worn by a person convicted of a crime. It is intended that this collar be worn by a "convict" whose confinement in a penal institution is deemed unnecessary, especially in view of the present invention itself. The collar will be sufficiently wide (or high) that it will be visible at all times; i.e., it should be sufficiently high that an ordinary shirt would not conceal the collar. Stated differently, it could be considered a violation of the wearer's "parole" to attempt to conceal the collar. The collar could be color coded to indicate the type and/or severity of the crime of which the wearer was convicted. The collar would be flexible, preferably made of plastic material, and yet sufficiently strong or durable that it could not be easily ruptured or broken without cutting through the band or strip of the collar itself. It is contemplated that the collar would be removed and/or replaced only by proper authorities. Considering the collar in greater detail, the collar is in the form of an elongated strip, preferably of plastic material as indicated above, and provided with four spaced holes at one end. The centers of these four holes could be considered as representing the four corners of a rectangle. The strip will vary in total length from approximately eighteen inches to about thirty inches so as to accommodate the varying neck sizes of the prospective wearers. The width of the collar can vary between one inch and two inches and is preferably about one and one-half inches wide.

From a position along the strip, approximately ten to twelve inches away from the end previously described and towards the opposite end, are a plurality of pairs of holes which are transversely aligned with the four holes described above. The additional pairs of or holes are preferably spaced apart a sub-multiple of the longitudinal spacing of the four holes referred to above. When the collar is placed around the neck of the wearer with the opposite end overlying the end having the four holes, the collar is adjusted to a comfortable length around the neck of the wearer such that the four rectangularly spaced holes first described above are in alignment with four holes on the overlying portion of the strip. At this juncture, excess material of the overlying portion can be cut off. A pair of rivet members are provided, each rivet member having a pair of integral tubular metallic rivets projecting outwardly from the base of each rivet member. Each rivet member is applied from the neck side of the collar and inserted first through a pair of the four holes first described above and through the aligned pair of holes in the overlying portion of the strip. A second rivet member is also applied through the neck side of the collar through the other two of the first four holes described above and through the aligned holes in the overlying portion of the strip. Now, a metallic plate having four holes therein arranged in the same rectangular arrangement as the first four holes described above, is placed over the four outwardly projecting rivets. The ends of the rivets are now flared using any conventional and well-known flaring tool so that the collar, with rivets and plate attached, is firmly secured around the neck of the wearer. The plate will have certain information imprinted thereon or impressed there such as the name of the wearer, his social security number, his blood type, and any other information which the authorities believe to be necessary or pertinent under the circumstances. The space on the strip itself between the first four set of holes described above and the additional holes can also be used to include any of the above information as desired.

It is well known that correctional institutions are overcrowded today. Although the release of certain prisoners from these institutions might pose a threat to society, nevertheless the release of other prisoners under proper conditions might be effected with a minimum of risk to society and might well be a benefit both to the prisoner and to society itself. The bottom line is that the correctional collar of the present invention is an acceptable alternative to incarceration.

DETAILED DESCRIPTION OF THE PREFERRED EMBODIMENTS

Figure 1:
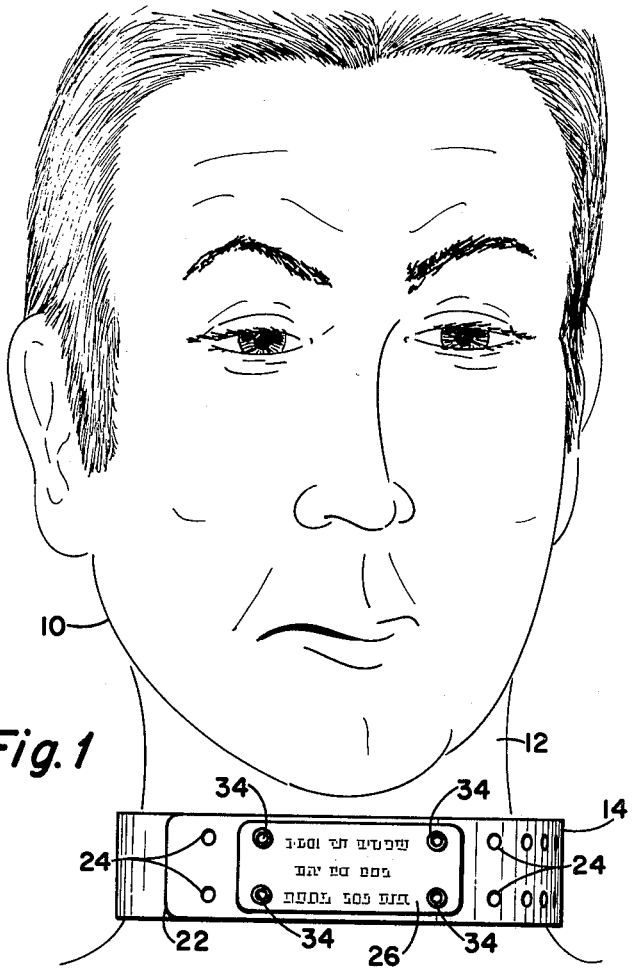
FIG. 1 is a front view showing the correctional collar of the present invention encircling the neck of a wearer.
Figure 2:
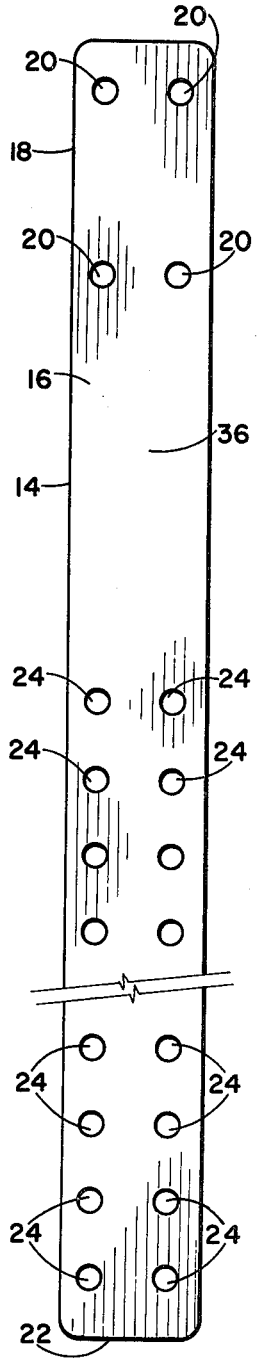
FIG. 2 is a plan view of the strip, with a portion broken away to show greater length representing the ultimate collar in a "flattened" condition and without the place or rivets attached.

Referring to the drawings in detail, FIG. 1 shows the head 10 of a man who will be referred to as a "convict"; that is, a person who has been convicted of a crime. Around the neck 12 of this man is disposed a correctional collar 14 which forms the subject matter of the present invention. Referring now to FIG. 2, the main portion of the collar 14 is an elongated strip 16, preferably of plastic material, and provided at one end 18 with four holes 20 spaced as indicated. The upper or end most holes 20 are adjacent the end 18 and the other pair of holes 20 are spaced a predetermined distance away from the upper holes 20 and parallel thereto. The centers of four holes 20 can be considered as representing the four corners of a rectangle. The strip 16 will vary in total length from approximately eighteen inches to about thirty inches so as to accommodate varying sizes of necks. The width of the collar can vary between one inch and two inches, and is preferably about one and one-half inches.

Figure 4:
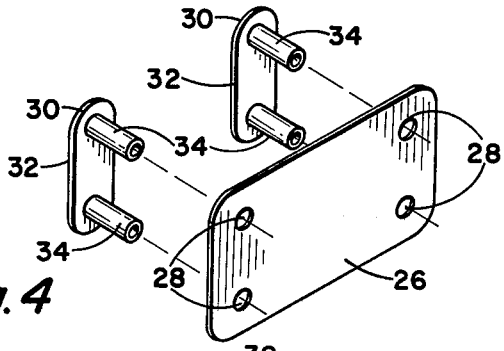
FIG. 4 is an exploded view of the plan and rivet assembly which is used to secure the strip of FIG. 2 to the neck of the wearer as shown in FIG. 1.

From a position approximately ten to twelve inches away from the end 18 of the collar 14, and towards the opposite end 22 of the strip 16, are another plurality of holes 24 which are (longitudinally) vertically aligned with the holes 20, as they appear in FIG. 2; however, adjacent pairs of holes 24 are spaced away from each other approximately one half the distance of the vertical separation between the adjacent pairs of holes 20. Assuming, for example, that the holes 20 are spaced approximately 1¼ inches apart in the longitudinal or vertical direction (in reference to FIG. 2), then the holes 24 would be spaced apart approximately ⅝ of an inch on a center to center basis. For the purposes of securing the strip 14 around the neck 12 of the man 10, there is provided a metal plate 26 having four holes 28 therein corresponding exactly to the positioning and size of the holes 20 previously described; also provided are a pair of metallic rivet members 30 each having a base 32 from which a pair of integral tubular metallic rivets 34 project forwardly, as best shown in the exploded view in FIG. 4.

Summarizing, the correctional collar 14 described above consists of an elongated flexible strip having a width 16 of about one to two inches and the length of about fifteen to thirty inches. Adjacent one longitudinal end 18 of the strip there is a first pair of transversely spaced holes 20 and a second pair of equally transversely spaced holes 20 longitudinally spaced a predetermined distance, approximately one and one-quarter inches, from the first pair of holes.These holes are also spaced inwardly from the longitudinal edges of the strip. Thus, these first two pairs of holes represent, as far as their centers are concerned, the four corners of a rectangle. At the other end 22 of the strip there are a plurality of additional pairs of transversely spaced holes 24 which have the same transverse spacing as the holes 20 but which are longitudinally spaced a second predetermined distance which is about one-half of the first predetermined longitudinal distance between the pairs of holes 20. The plate 26 has a width greater than the transverse spacing between the holes and a length greater than the longitudinal spacing (the first predetermined distance) between the holes 20. Thus, the holes 28 provided in the plate 26 correspond in size and location with the holes 20. The rivets 34 of the rivet members 30 have an outer diameter equal to or smaller than the holes 20, 24 and 28. The center to center distance between the rivets 34 on each rivet member 30 is equal to the center to center transverse spacing for the holes.

Figure 3:
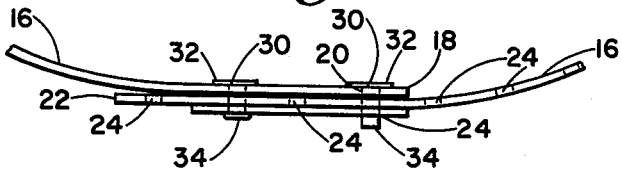
FIG. 3 is a fragmentary planned view of the forward portion of the collar shown in FIG. 1, with certain hidden points being shown by dotted lines and further showing one of the rivets in an unflared condition.

In order to secure the collar 14 around the neck, the rivet members 30 are attached to the collar by inserting the rivets 34 into the pairs of holes 20 at the end 18 at the stip 16. The strip 16 is then applied to the neck 12 with the tubular rivets 34 projecting outwardly away from the neck. The strip is then circled around the neck and closed to a comfortable fitting position around the neck 12; then the projecting ends of the rivets 34 are joined to the overlying end of the strip 16 by inserting them through the holes 24 which most closely approximate the position of the outwardly projecting tubular members 34. Now the plate 26 is inserted over the still projecting ends of the rivets 34, and a convenient tool (not shown) which is customarily employed to flare out the ends of rivets is applied to the tubular rivets 34 to flatten the outer ends as shown in the lower left hand portion of FIG. 3. At the lower right hand portion of FIG. 3, the rivet 34 projecting outwardly has not yet been flattened. It should be understood that this right hand rivet will be flattened also to complete the attachment of the collar to the man 10. Any excess material at the end 22 is cut off so that the end 22 now appears as shown in FIGS. 1 and 3. If desired, the name and number of the convict can be stamped into the metal plate 26 as diagramatically indicated in FIG. 1. Also, if desired, the social security number, name, and/or blood type can be put on the strip 16 at the location indicated by the reference numeral 36 in FIG. 2.

Whereas the present invention has been described in particular relation to the drawings attached hereto, it should be understood that other and further modifications, apart from those shown or suggested herein, may be made within the spirit and scope of this invention. For example, the plate 26 described above, or the strip 14 can be provided with an electronic chip attached thereto or embedded therein for periodic check-in purposes and/or identification; with the use of the electronic chip the wearer of the correctional collar could check in at various stations provided for this purpose where electronic devices could be actuated by the chip as possible compliance with the conditions imposed upon the wearer.

What is claimed is:

1. A correctional collar to be worn around the neck of a person convicted of a crime comprising an elongated flexible strip having a width of about one to two inches and a length of about fifteen to thirty inches; said strip having a first pair of transversely spaced holes adjacent one longitudinal end of the strip, said first pair of holes being spaced inwardly from the longitudinal edges of said strip and being located generally along a line perpendicular to the longitudinal edges of said strip; said strip being provided with a second pair of transversely spaced holes arranged in parallel relation and longitudinally spaced a first predetermined distance away from said first pair of holes, the centers of said first and second pair of holes representing the four corners of a rectangle; the end of said strip opposite from said one end being provided with a plurality of additional pairs of transversely spaced holes arranged in parallel relation to each other and parallel to said first and second pairs of holes; each pair of holes of said additional pairs of holes being longitudinally spaced from each adjacent pair a second predetermined distance, the holes of all pairs of holes having the same transverse spacing; a plate carrying identification information thereon and having a width greater than the transverse spacing between the holes of each pair of holes and a length greater than said first predetermined distance and having holes therein corresponding in size and position to said first and second pairs of holes in said strip; first and second rivet members for securing said plate to said strip; each rivet member having a base and a pair of rivets projecting outwardly from the base in parallel relation to each other and spaced apart about a distance equal to the transverse spacing between the holes of each pair of holes, the outer diameter of each rivet in unflared condition being such that the rivet can pass through the holes in said strip and the holes in said plate; whereby said strip can be placed around the neck of said person with the said opposite end of said strip overlying said one end of said strip, the rivets of said first rivet member can be inserted through said first pair of holes, through a pair of said additional set of holes and thence through a pair of holes on said plate after which the projecting ends of the rivets of said first rivet member can be flared, and whereby the rivets of said second rivet member can be inserted through said second pair of holes, through another pair of said additional set of holes, and thence through two other pair of holes of said plate after which the projecting ends of the rivets of said second rivet member can be flared to lock the plate against the strip in encircling relation around the neck of said person, wherein said second predetermined distance is one-half of said first predetermined distance.

* * * * *